United States Patent [19]

Gilpatrick

[11] Patent Number: 4,953,270

[45] Date of Patent: Sep. 4, 1990

[54] METHOD FOR MARKING TEXTILE SUBSTRATES

[75] Inventor: Michael W. Gilpatrick, Chesnee, S.C.

[73] Assignee: Milliken Research Corporation, Spartanburg, S.C.

[21] Appl. No.: 93,365

[22] Filed: Sep. 4, 1987

[51] Int. Cl.[5] ..... D06C 23/00

[52] U.S. Cl. ..... 28/163

[58] Field of Search ..... 28/160, 163; 26/69 R, 26/7; 83/33, 53, 76

[56] References Cited

U.S. PATENT DOCUMENTS

| | | | |
|---|---|---|---|
| 1,059,200 | 4/1913 | Parkinson et al. | 26/69 R |
| 1,860,528 | 5/1932 | Buesser | 26/7 |
| 2,252,123 | 8/1941 | Gross | 26/69 C |
| 4,573,382 | 3/1986 | Kloehn et al. | 83/53 |
| 4,620,466 | 11/1986 | Jumel et al. | 83/53 X |

FOREIGN PATENT DOCUMENTS

| | | | |
|---|---|---|---|
| 0177277 | 4/1986 | European Pat. Off. | 28/163 |
| 501891 | 4/1920 | France | 26/7 |

*Primary Examiner*—Werner H. Schroeder
*Assistant Examiner*—David K. Suto
*Attorney, Agent, or Firm*—George M. Fisher; H. William Petry

[57] ABSTRACT

An arrangement of spaced blade-like members in the form of a cut/fray module is used to make distinctive marks on textile fabrics, especially of woven construction. A sharpened blade-like member penetrates the fabric and cuts yarns while adjacently penetrating dull-edged members cause the severed yarn ends to become disentangled and removed from the fabric structure, resulting in a frayed edge below the incision and "floating" yarns in the region of the incision.

3 Claims, 5 Drawing Sheets

METHOD FOR MARKING TEXTILE SUBSTRATES

This invention relates to the marking or patterning of textile substrates. In particular, this invention relates to a method and apparatus for marking or patterning certain textile substrates, especially of woven construction, wherein a cutting/fraying module of novel design is used to cut yarns in small, well-defined areas of the substrate surface and simultaneously induce an unraveling or disentangling effect in the cut yarns so as to disengage the cut end portions of the cut yarns from the structure of the fabric and produce a distinctive, permanent mark on the substrate. Products embodying the invention are also disclosed.

In one embodiment of the invention, a flat, blade-like "cutting" member having a sharp edge is mounted in spaced relation between a pair of similarly shaped, but dull-edged "fraying" members. As they penetrate the textile substrate, the sharp edge on the cutting member severs one or more yarns or yarn bundles lying in a direction transverse to the direction of the incision, while the dull edges of the fraying members cause the severed yarn ends to become disentangled and displaced below the plane of the substrate and thereby expose, in the area immediately surrounding the severed yarns, the unsevered yarns lying substantially perpendicular to the severed yarns. The resulting combination of severed yarn displacement and unsevered yarn exposure forms a distinctive visual effect which varies in accordance with (1) the construction of the substrate, (2) the angle, relative to the direction of the warp and fill yarns, at which the "cutting" and "fraying" edge combination passes through the plane of the substrate, (3) the nature and number of, and the relative spacing and positioning among, the "cutting" and "fraying" edges, (4) the nature of the yarns comprising the substrate, as well as other factors.

Further details, uses, and advantages of the invention will become apparent from the following description and discussion, including the accompanying drawings and claims. The drawings disclose aspects or embodiments of the invention in accordance with the following brief description:

Figure 2:
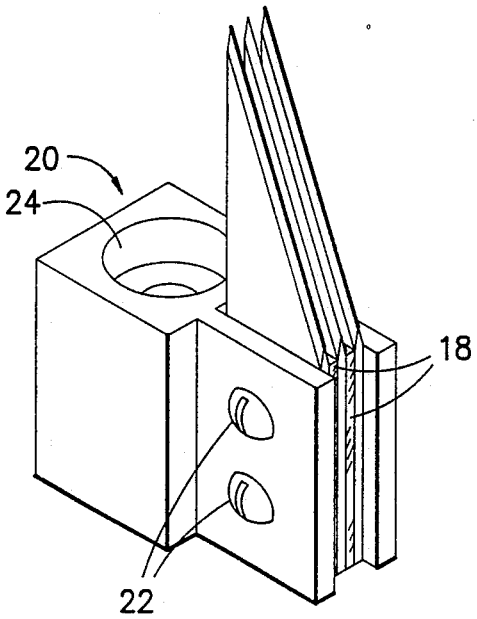
FIG. 2 depicts one embodiment of a cut/fray module embodying the invention, comprising a single, centrally positioned "cutting" edge and two flanking, symmetrically positioned "fraying" edges.
Figure 3:
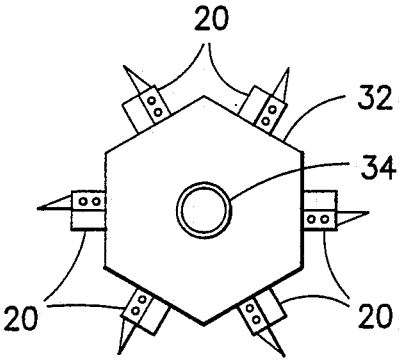
FIGS. 3 and 4 show an arrangement of a plurality of the modules of FIG. 2 mounted on a drum.
Figure 4:
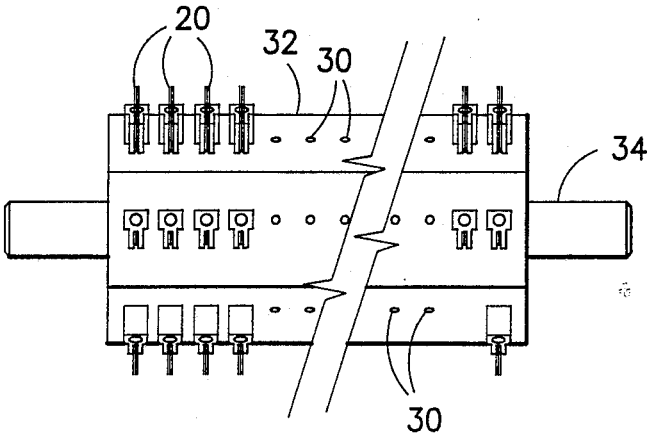
Figure 5:
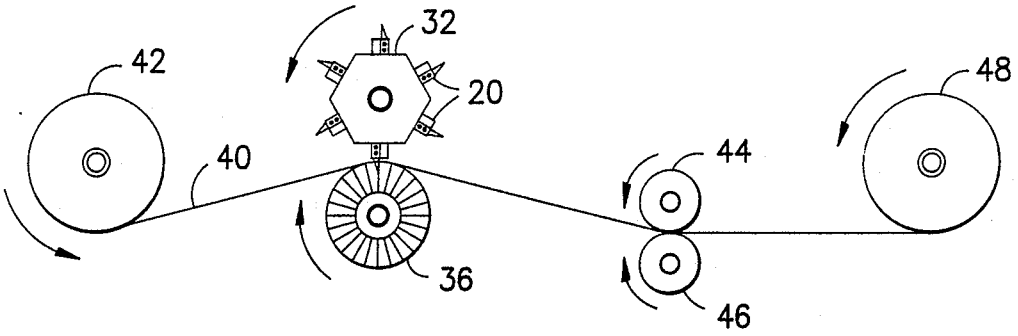
Figure 6:
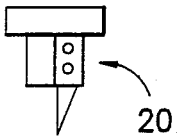
Figure 7:
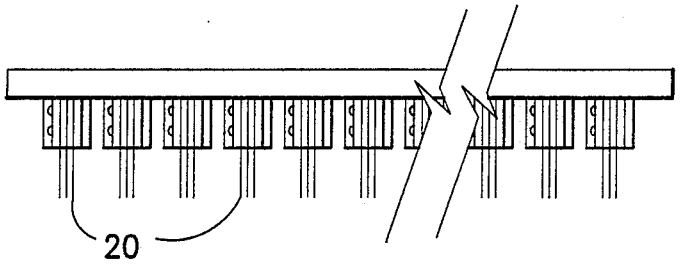
Figure 8:
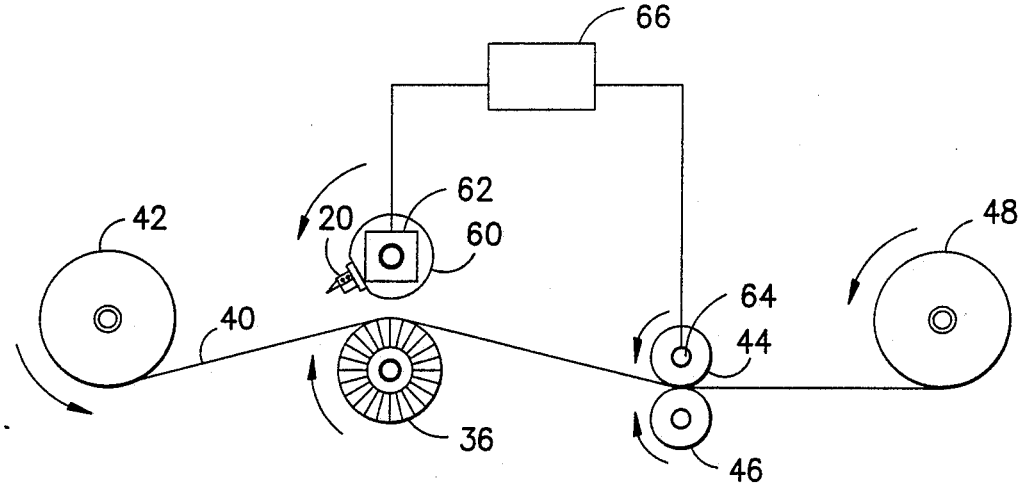
Figure 8A:
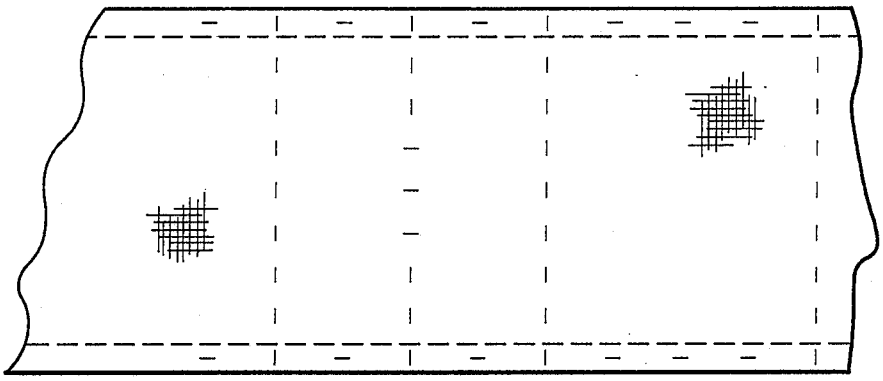

FIG. 5 schematically depicts an apparatus utilizing the drum of FIGS. 3 and 4 for marking or patterning fabric web;

FIGS. 6 and 7 schematically depict end and front views, respectively, of an individual linear array of cut/fray modules having a blade configuration similar to the module of FIG. 2;

FIG. 8 schematically depicts an apparatus embodying the invention which may be used to place an array of index marks or cutting marks across the width of fabric web at pre-determined intervals;

FIG. 8A depicts a woven fabric web, with a selvage at each side, having index marks made by the apparatus of FIG. 8, where the index marks are at regular intervals in the warp direction, and where different combinations of index marks are used to indicate different elapsed distances along the web.

Figure 9:
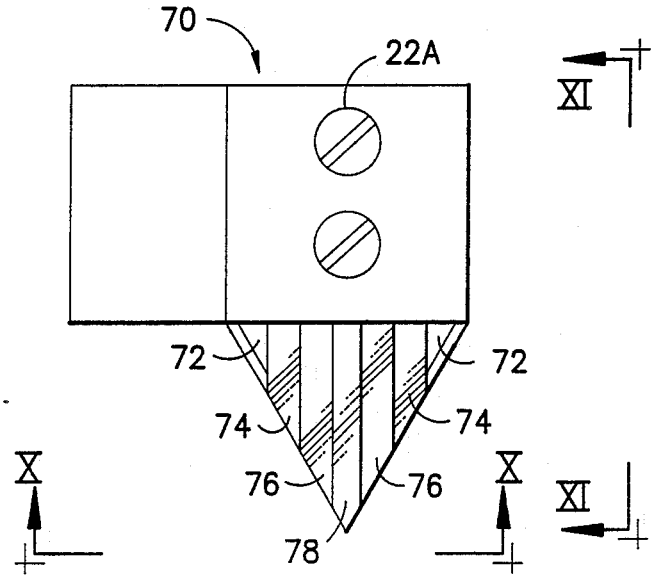
Figure 11:
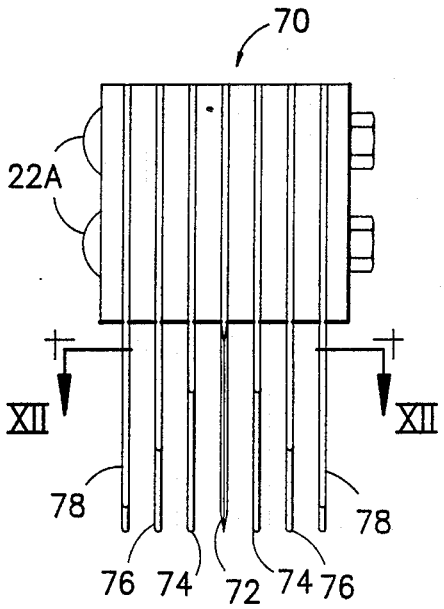
Figure 10:
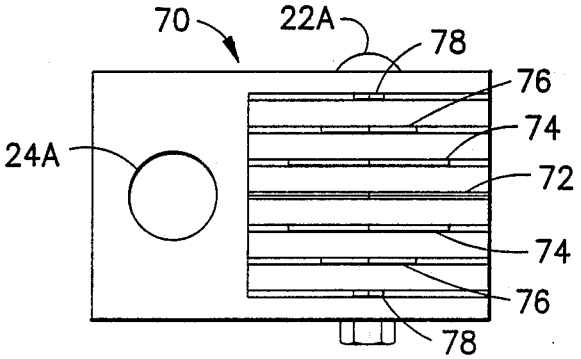
Figure 12:
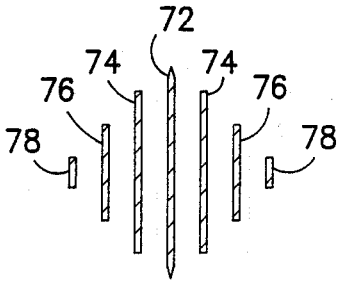
Figure 13:
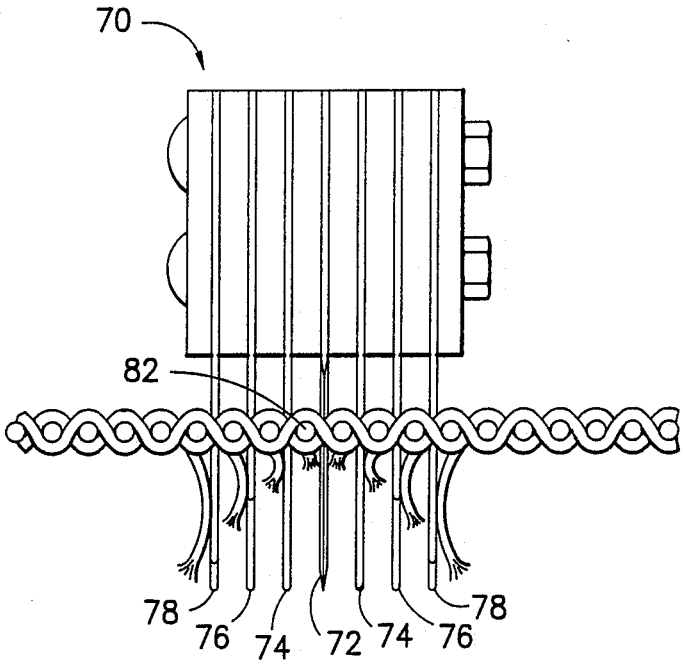
Figure 14:
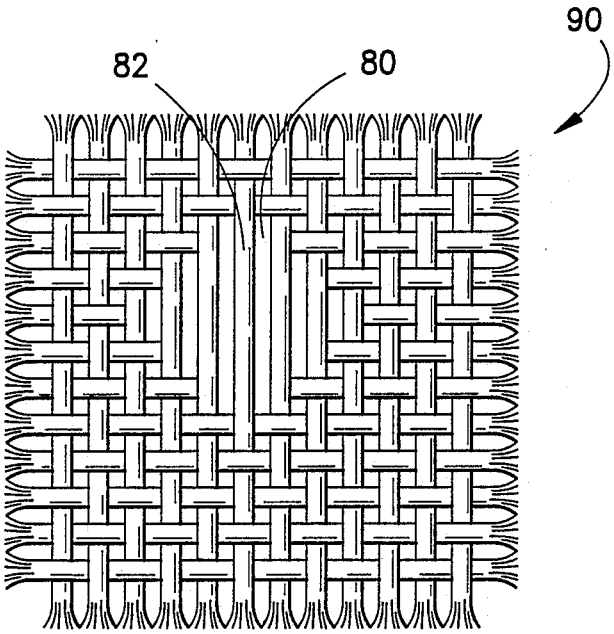

FIG. 9 depicts an alternative configuration for a cut/fray module, in which a double-edged central blade is flanked on each side by three fraying blades having decreasing width;

FIGS. 10 and 11 are views of the module of FIG. 9 as viewed from below and from the front, as indicated along lines X—X and XI—XI of FIG. 9, respectively;

FIG. 12 is a section view of the cutting and fraying members of the module of FIG. 9, as viewed along line XII—XII of FIG. 11;

FIG. 13 depicts a cross-section of woven fabric which has been penetrated by the module of FIGS. 9–12, showing the disentanglement of the cut end portions of the severed yarn and their disengagement and displacement from the woven structure of the fabric;

FIG. 14 depicts a simplified view of the fabric of FIG. 13, as viewed from the direction of module penetration, following removal of the cut/fray module.

Figure 15:
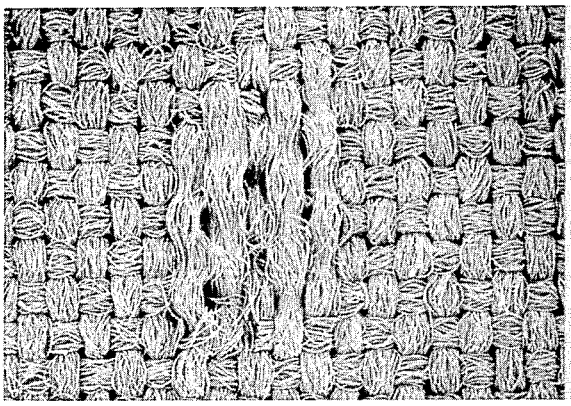
Figure 16:
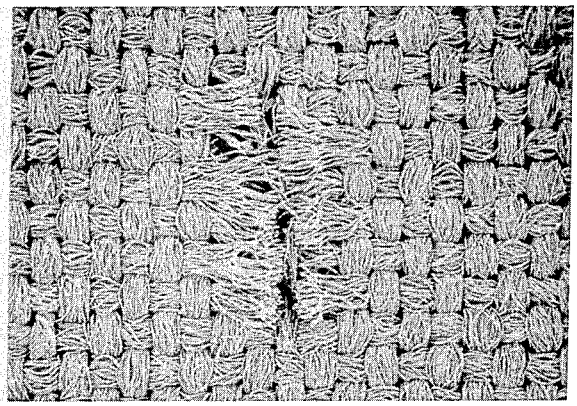
Figure 17:
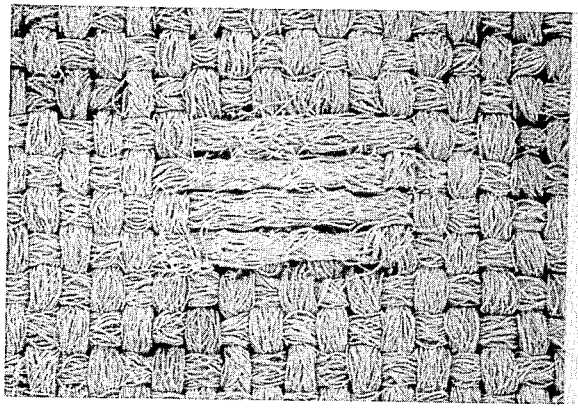
Figure 18:
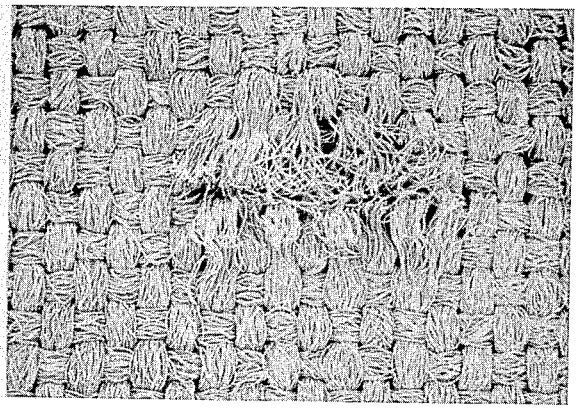

FIGS. 15 and 16 are scanning electron photomicrographs (15×, no tilt) showing the front and back, respectively, of a woven fabric (warp extending from top to bottom) treated in accordance with this invention, wherein the cut/fray module of FIG. 2 penetrated the fabric in a direction parallel to the warp yarns;

FIGS. 17 and 18 are scanning electron photomicrographs (15×, no tilt) of the front and back of the fabric of FIGS. 15 and 16, similarly oriented, wherein the cut/fray module of FIG. 2 penetrated the fabric in a direction perpendicular to the warp yarns, i.e., parallel to the fill yarns.

Figure 1A:
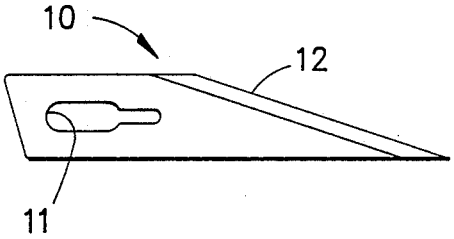
FIG. 1A depicts a blade useful in practicing the invention which has a sharp edge for use as a "cutting" edge.
Figure 1B:
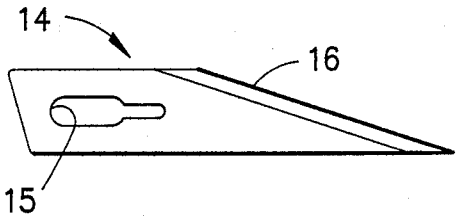
FIG. 1B depicts a blade useful in practicing the invention in which the sharp edge has been intentionally dulled, thereby forming a "fraying" edge.

FIGS. 1A, 1B, and 2 collectively depict blades and one embodiment of a cutting/fraying module constructed in accordance with the instant invention. In the embodiment depicted, blade 10 is a flat, planar member similar to a standard disposable-type cutting blade such as is used in woodworking o graphics arts applications. Other blades having different sizes, edge configurations, etc. may be used, as discussed below. Edge 12 has been maintained in a sharp cutting condition. Blade 14 is a blade similar to blade 10, except that edge 16 has been intentionally dulled or otherwise treated so that it will not cut all the yarns it contacts as blade 14 penetrates the desired fabric substrate. For certain effects, it may be desirable to adjust the sharpness of "dull" edge 16 so that some of the yarns contacting edge 16 are completely or partially severed as blade 14 penetrates the desired fabric substrate. If desired, one or more blades having an appropriately toothed, contoured, or roughened edge may be substituted for corresponding "dull" blades 14, so long as the primary function of the "dull" blade is maintained, i.e., the unraveling or disentangling of the cut end portion of the cut yarns and displacement of the cut end portions of the severed yarns from the structure of the fabric (i.e., "fraying). It should be noted that the "dull" blade also places under relative tension the yarns to be cut by blade 10, and thereby facilitates the incision-making function of "sharp" edge 12. It is important, however, that the "dull" blade is pointed to permit its unimpeded passage through the fabric without tearing the fabric. It is foreseen that the fraying blade may take the form of a dagger or rapier-like blade, such as is incorporated in the cutting/fraying module depicted in FIGS. 9–12 and described in greater detail hereinbelow.

Module 20, as depicted in FIG. 2, is comprised of a single sharpened blade 10 which is laterally aligned with and mounted between two blades 14 with dulled edges. Blades 10,14 may be affixed in module 20 by means of clamping screws 22 which extend through apertures 11,15 of blades 10,14, or by other conventional means. Spacers 18 are used to maintain a desired parallel spacing between adjacent blades; this spacing may range from a minimum equal to the approximate diameter of the yarn used in the fabric to be treated to a maximum determined by the tendency of the fabric to unravel under the combined actions of blades 10 and 14 as they simultaneously penetrate the fabric substrate. Generally inter-blade spacings of from about 0.02 inch to about 0.2 inch or more are preferred in connection with most fabric substrates. It is foreseen that, where special effects are desired or where unusual fabrics are involved, multiple cutting blades, unequal or non-parallel spacings on either side of the cutting blade(s), or spacings outside the above range ma be desirable.

The apparatus depicted in FIGS. 3 through 5 is an example of a machine which uses the module of FIG. 2 to mark a fabric substrate. As shown, a plurality of modules 20 have been attached to the face of drum 32. The module embodiment shown in FIG. 2 is depicted with a mounting sleeve 24, which can accommodate the insertion of a lag bolt which may be threaded into threaded socket 30 on the face of drum 32. Other suitable mounting systems, which need not require the use of sleeve 24, may be employed.

Drum 32 is depicted as being hexagonal in axial cross-section; this is merely one preferred embodiment. Drums having, for example, octagonal, circular, or non-symmetric axial cross-sections may also be used, as depicted in the drum configuration shown in FIG. 8. Also, the arrangement of modules 20 on the surface of drum 32 is dependent only upon the pattern or marking effect desired; it is foreseen the modules 30 may be arranged on a suitably configured drum to form an offset, curved, or other pattern, if desired.

As depicted in FIG. 5, drum 32 is mounted, via drum axle 34, opposite axle-mounted support roll 36, which preferably has a surface which is suitable for repeated penetrations by blades 10,14, without excessive injury to either the roll surface or the blade edges. A preferred roll construction is a brush roll comprised of radially oriented, closely spaced bundles of synthetic fibers which will prevent excessive dulling of or damage to the blade edges. Fabric web 40 is drawn from supply roll 42 through the gap between drum .32 and support roll 36. Nip rolls 44,46 serve to assist in holding fabric web 40 in firm contact with support roll 36, and in maintaining moderate tension on web 40. In a preferred embodiment, one or the other of rolls 44,46 serves the function of measuring the length or speed of web 40 passing through the roll interface, so that drum 32 may be driven in a synchronous manner, thereby resulting in a regular, reproducible pattern. Take-up roll 48 serves to assist in transporting web 40 through the apparatus and to provide temporary storage for web 40 following processing. Although not shown, it is preferred that, other than drum 32, at least take-up roll 48 be driven; optionally, one or the other of nip rolls 44,46, as well as support roll 36, may also be driven.

Drum 32 is made to rotate by suitable conventional means in the direction indicated, so that blades 10,14 are travelling in the same direction relative to the direction of web 40. As depicted, blades 10,14 approach web 40 with edges 12,16 in a trailing orientation, i.e., edge rearward. The orientation of blade edges 12,16 with respect to the direction of fabric travel or the direction of drum rotation, which determines whether blade edges 12,16 are positioned on the leading or trailing edge of the fabric puncture, will depend upon the effect desired. It is believed that where the blade edges are in a trailing (i.e., facing opposite the direction of web travel) orientation, the resulting incision will be elongated in that direction as compared with the incision produced by a blade edge oriented in a leading orientation (i.e., facing the direction of web travel). While it is preferred that the direction of drum rotation be the same as the direction of web movement, it is not necessary that the circumferential speed of the cutting edges on the drum perimeter match the linear speed of the fabric. Relative differences in such speeds will also tend to increase or reduce the length of the incision. The preferred depth of penetration of blades 10,14, as well as the angle of penetration, will depend upon the nature of the web material, the effect desired, the nature of support roll 36, the shape of the blade, etc. Generally, penetrations on the order of about 0.05 to about 0.35 inch are preferred.

It is envisioned that, in many applications, only one mark, or a series of marks in a straight line array across the width of the fabric web, may be desired. For example, it may be useful to place marks in the selvage at one, five, or ten yard intervals along the length of a fabric web to keep track of elapsed yardage or to assist in identifying the location of defects. Different marks may be used to identify various elapsed distance intervals. If a clear cutting line is desired, it may be advantageous to place closely spaced marks across the width of the web at the desired cutting location.

These applications can be met using the devices shown in FIGS. 6 through 8. FIGS. 6 and 7 show, in side and front views, respectively, a linear array of cut/fray modules similar to that shown in FIG. 2. The modules may be affixed to the array support in any suitable manner. Where only one or two marks on the fabric are desired, e.g., along the selvage, the array may be replaced with one or two individual cut/fray modules positioned and affixed appropriately along the length of the array.

FIG. 8 shows a machine in which either the blade array of FIGS. 6 and 7 or one or more individually positioned and affixed cut/fray modules may be utilized to place markings on a web. In FIG. 8, the individual modules or module array are shown installed on the face of driven member 60. If one or more modules are employed for the purpose of marking elapsed web travel, it may be preferred that the modules be aligned with the selvage of fabric web 40. Member 60, driven by conventional means, not shown, may be actuated by means of a single revolution clutch 62, which in turn is engaged by a signal generated by conventional control circuitry 66 in response to web length measurement data taken from a rotation sensor 64 associated with one or the other of rolls 44,46. At specified intervals of elapsed web travel, sensor 64 sends web travel data to circuitry 66. Clutch 62, and therefore module 20, is engaged by circuitry 66 each time the received web travel data indicates a predetermined length of web has passed rolls 44,46.

After bringing the affixed cut/fray module into operable association with the face of web 40 and causing the blade edges to penetrate the substrate, the single revolution clutch 62 causes member 60 to undergo a single revolution, bringing the module into a pre-determined, repeatable relative position with respect to web 40, as shown in FIG. 8, from which member 60 may again be actuated. By synchronizing the passage of a pre-determined length of web 40 as measured by the angular rotation sensor 64 associated with one or the other of rolls 44,46, and processed by circuitry 66 with the actuation of clutch 62, the affixed module can be made to penetrate and permanently mark web 40 at well defined, spaced intervals. Using multiple modules to generate different marks, e.g., in order to indicate different elapsed web lengths, may require use of more than one driven member/clutch combination. Alternatively, one may use a clutch which undergoes a fractional part of a revolution at each actuation, in combination with a driven member on which multiple modules are mounted at various location around the perimeter. Other locations for angular rotational sensor 64, or other means of synchronizing the actuation of member 60, may be apparent to those skilled in the art.

FIGS. 15 through 18 are photomicrographs showing a fabric which has been treated in accordance with the instant invention. The fabric is a plain weave fabric of 100% textured polyester in both warp and fill, with seventy ends and fifty-eight picks per inch. FIGS. 15 and 16 show the effects of treatment with a cut/fray module as represented in FIG. 2 with the plane of the blades parallel to the warp direction. For purposes of discussion, this blade orientation will be referred to as having a 0° angle of attack. As can be seen in FIG. 15, the front of the fabric (i.e., the side of initial blade penetration) shows exposure or "floating" of the warp yarns, and corresponding complete subjacency or turning under of fill yarns, in the region of the blade penetrations. The width of this region, i.e., the distance between the outermost exposed fill yarns, is roughly equal to the distance between the outermost blades in the cut/fray module. FIG. 16 shows the back (i.e., side opposite the side of initial blade penetration) of the fabric of FIG. 15 and shows the severed subjacent fill yarns which have been frayed and/or disentangled and have been displaced from the fabric structure on either side of the incision made by the center blade of the cut/fray module.

FIGS. 17 and 18 show the same fabric, except the cut/fray module blades were oriented perpendicular to the warp direction. For purposes of discussion, this blade orientation will be referred to as having a 90° angle of attack. As can be seen by looking at the face of the fabric shown in FIG. 17, the fill yarns have been exposed or made to "float" by the subjacency or turning under of the warp yarns across a width of fabric roughly equal to the spacing between the outermost "fraying" blades in the cut/fray module, while FIG. 18 shows the frayed and/or disentangled warp yarns which have been displaced and which protrude from the back of the fabric.

It is foreseen that other intermediate angles of attack could be employed advantageously for the generation of special effects, or for noting the passage of different elapsed distance intervals, although angles of attack substantially different from 0° or 90° will tend to produce holes with frayed edges on most fabrics of conventional woven construction. It is further foreseen that desirable effects may be obtained by adjusting the size, shape, sequence, numbers, and relative anterior/posterior or elevational position of the various blades in the module. The lengths of the cutting and fraying blades need not be equal, although it is preferred that any fraying blade be no longer than the longest cutting blade. It should also be noted that, where the fraying blades are substantially shorter than the cutting blade, the fraying blades can no longer apply tension to the yarns to be cut by the cutting blade(s). For this reason, it is preferred that the cutting and fraying blades be of approximately equal length, so that they contact the fabric surface substantially simultaneously. It is also preferred that any edge on the sharpened blade which contacts the fabric and which is not parallel to the direction of insertion and withdrawal of the blade module should be sharpened.

Alternative configurations for cut/fray modules are contemplated; one such configuration is shown in FIGS. 9–12. This blade arrangement is comprised of a centrally positioned flat blade member 72 having a double edge in the form of a "V", as viewed broadside. Dulled fraying blades 74, 76, and 78 are arranged in spaced parallel alignment on either side of blade 72, and, as depicted, outer blades are made progressively less wide, resulting in outermost blade 78 having a rapier-like appearance. These blades are in lateral alignment, i.e., when viewed broadside, all blades in the module fall within the silhouette of the widest blade, which is preferably a cutting blade. The individual blades may be positioned via bolts 22A, or by other means. The module itself may be affixed to the engaging apparatus by way of mounting sleeve 24A, or by other means apparent to those skilled in the art.

The blade configuration shown in the module 70 o FIGS. 9 through 12 may be used to generate a design wherein the severed yarns are disentangled from the weave structure in an area having the shape of a diamond, as depicted in FIGS. 13 and 14. As shown in these Figures, central cutting blade 72 passed through fabric area 80 of fabric 90, to the immediate right of yarn 82. Fraying blades 74,76, and 78 pushed the cut yarn end portions to the underside of fabric 90 (i.e. the side opposite the blade insertion side of the fabric), resulting in an open, diamond-shaped area of "floating" yarns on the blade-insertion side of fabric 90, as depicted in FIG. 14.

Of course, changing the width of any of the fraying blades 74, 76, or 78 would result in a change in the pattern of FIG. 14. Other variations, such as the vertical angle at which the blade penetrates the plane of the fabric, may also be employed to produce desired effects. It is contemplated that, for non-mensuration applications, the various cut/fray modules contemplated herein can be used for generating fabrics having visually pleasing and distinctive permanent patterns by arranging and orienting the marks produced by the modules in a pleasing pattern on the fabric.

The nature of the fabric will determine the effect produced by the cut/fray module. A preferred substrate is on in which the constituent yarns or yarn groups, or at least significant numbers of such yarns or yarn groups, lie substantially perpendicular to each other, as is found in most woven fabrics of conventional construction. It is believed non-woven fabrics in which substantial numbers of yarns or yarn groups are positioned at approximately right angles may also be advantageously employed. Within these broad groups, it is foreseen that various combinations of yarns or yarn groups having different colors, reflectivity, bulk levels, denier, construction, composition, finish, shrinkage characteristics, heat history, etc. may be used to produce novel and visually attractive effects.

While the invention has been particularly shown and described with reference to preferred embodiments, it will be understood by those skilled in the art that changes in form and details ma be made to the specific teachings herein without departing from the spirit and scope of the invention.

I claim:

1. A method for marking a textile fabric, said fabric comprised of a plurality of yarns oriented in a first direction and a plurality of yarns oriented in a second, substantially perpendicular direction, said former and latter yarns defining a fabric plane, said method comprising simultaneously (a) forming an incision in said fabric by inserting a planar member having a sharpened edge, which penetrates said fabric plane and which is parallel to said first direction, thereby cutting yarns oriented in said second, substantially perpendicular direction without cutting said yarns oriented in said first direction;

(b) disentangling those portions of cut yarns nearest said incision from uncut yarns nearest said incision which are oriented in said first direction; and (c) displacing said disentangled yarn portions nearest said incision from said fabric plane.

2. The method of claim 1 wherein said disentangling is performed along an entire length of said incision.

3. The method of claim 1 wherein said disentangling is performed only along a portion of the length of said incision.

* * * * *